US005581964A

United States Patent [19]

Pizer

[11] Patent Number: 5,581,964

[45] Date of Patent: Dec. 10, 1996

[54] WALL PANEL SUPPORT AND SECUREMENT COMBINATION

[75] Inventor: Andrew J. Pizer, 121 S. Monroe St., Waterloo, Wis. 53594

[73] Assignee: Andrew J. Pizer, Waterloo, Wis.

[21] Appl. No.: 972,163

[22] Filed: Nov. 5, 1992

[51] Int. Cl.[6] ..... E04B 1/38

[52] U.S. Cl. ..... 52/285.3; 52/712

[58] Field of Search ..... 52/698, 370, 262, 52/270, 284, 285, 294–297, 712–714, 731.9

[56] References Cited

U.S. PATENT DOCUMENTS

| | | | |
|---|---|---|---|
| 2,929,237 | 3/1960 | Lancer | 52/713 X |
| 3,842,554 | 10/1974 | Swick | 52/713 X |
| 3,861,104 | 1/1975 | Bower | 52/713 X |
| 3,864,889 | 2/1975 | Hobbs | 52/714 X |
| 3,881,293 | 5/1975 | Conville | 52/712 |
| 3,910,001 | 10/1975 | Jackson | 52/712 X |
| 4,333,286 | 6/1982 | Weinar | 52/714 X |
| 4,366,660 | 1/1983 | Pearson | 52/712 X |
| 4,553,363 | 11/1985 | Weinar | 52/731.9 X |
| 4,641,473 | 2/1987 | Trezza | 52/714 X |
| 4,777,778 | 10/1988 | Taupin | 52/714 |
| 4,841,690 | 6/1989 | Commins | 52/712 X |

FOREIGN PATENT DOCUMENTS

| | | | |
|---|---|---|---|
| 2547002 | 5/1976 | Germany | 52/714 |

*Primary Examiner*—Suzanne L. Dino
*Attorney, Agent, or Firm*—Hill, Steadman & Simpson

[57] ABSTRACT

A nailer device for securing abutting edges of a first and second construction panel to a support timber or top plate includes a planar member which in use of the device is disposed contiguously relative to the first panel and between the first panel and the top plate. A further planar member is rigidly secured to the planar member and is disposed perpendicularly relative thereto such that the planar and further planar members define therebetween an elongate recess for the reception therein of the top plate so that the device is supported by the top plate. The planar members also define therebetween a further elongate recess which is disposed on an opposite side of the planar member relative to the top plate such that the abutting edges of the panels are located within the further elongate recess with the second panel disposed contiguously relative to the further planar member. Also, a fastener fastens the device to the top plate.

13 Claims, 2 Drawing Sheets

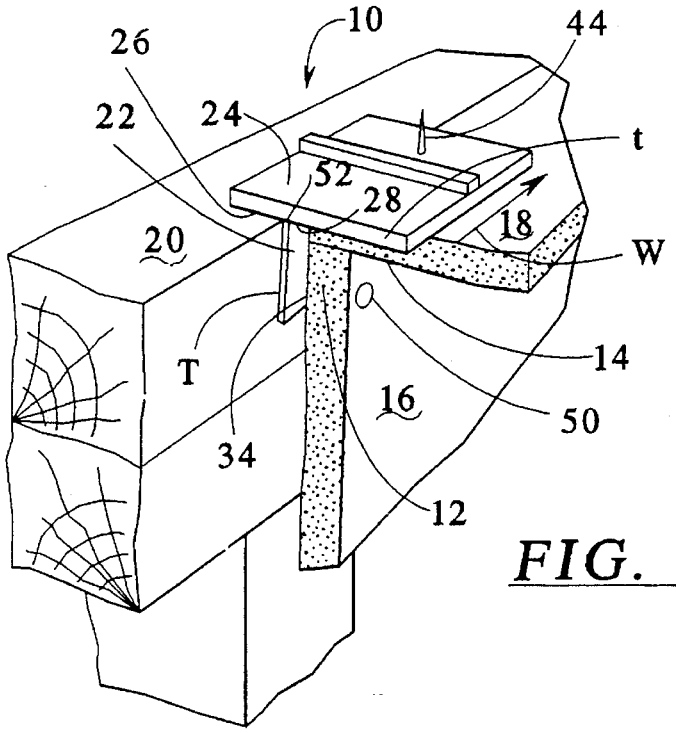
FIG. 1
FIG. 2
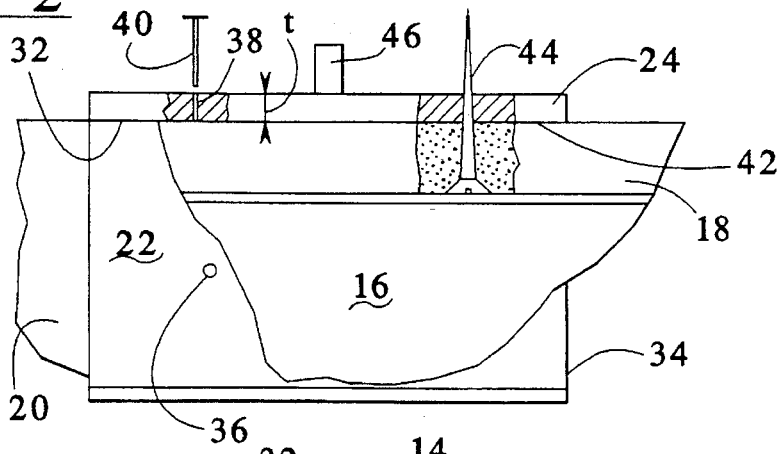
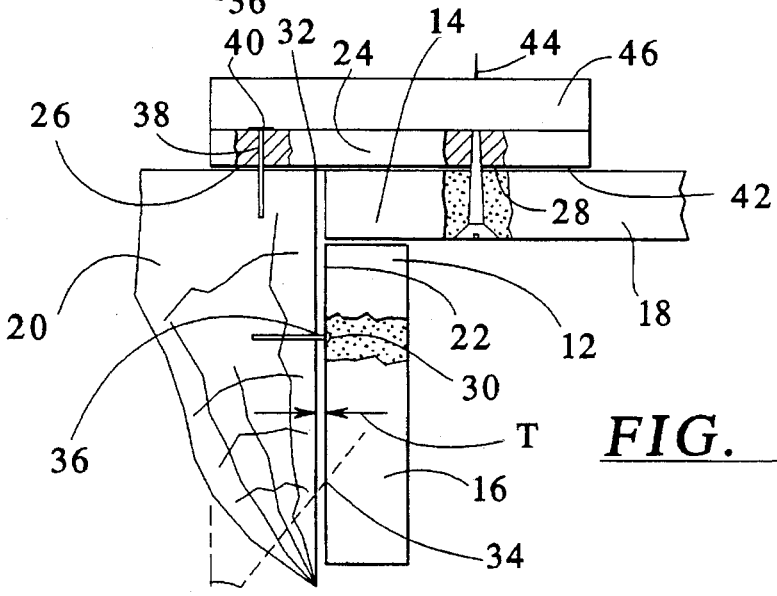
FIG. 3

FIG. 4
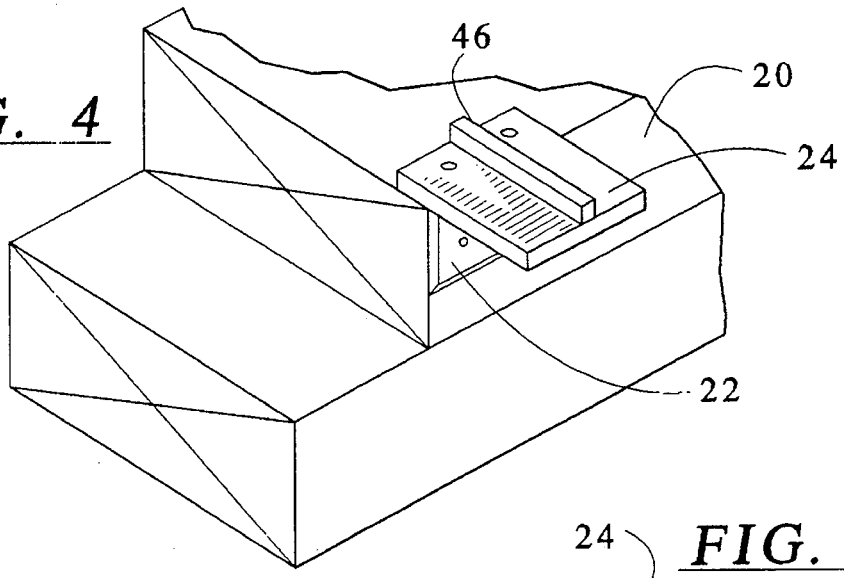
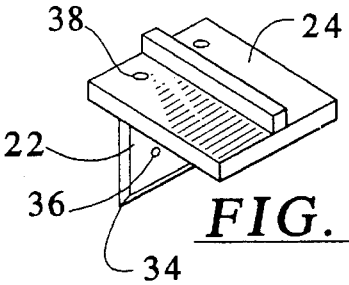
FIG. 5
FIG. 6
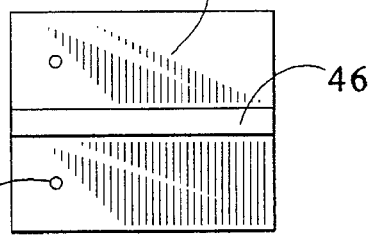
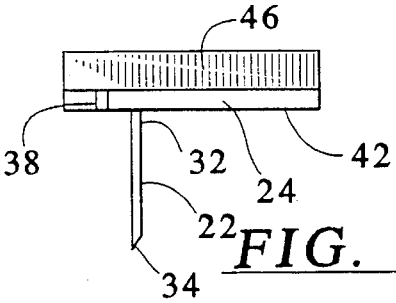
FIG. 7
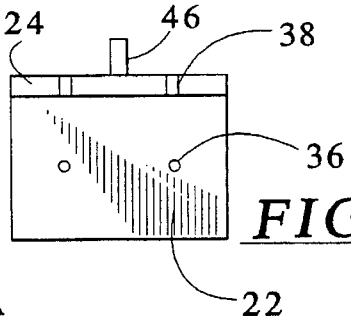
FIG. 8
FIG. 9
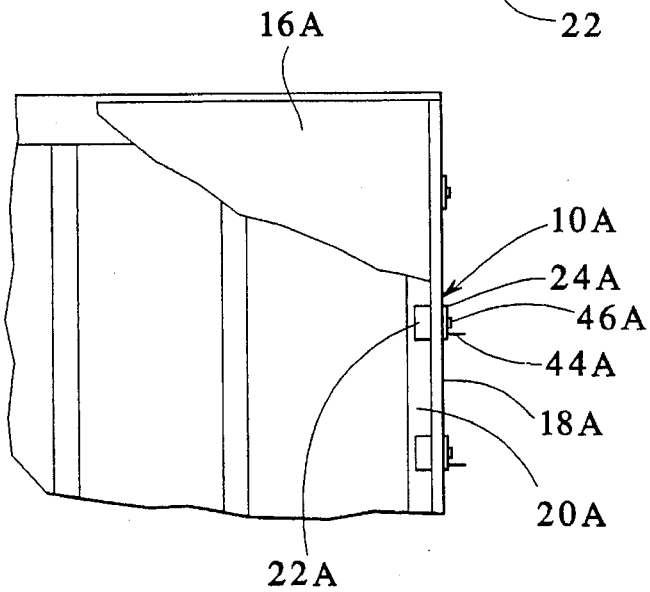

WALL PANEL SUPPORT AND SECUREMENT COMBINATION

BACKGROUND OF THE INVENTION

1. Field of the Invention

The present invention relates to a nailer device for securing abutting edges of a first and a second construction panel. More specifically, the present invention relates to a nailer device for securing abutting edges of construction panels to a support beam such as a top plate.

2. Information Disclosure Statement

Particularly in the construction industry, sheetrock is used for covering walls and ceilings and for the construction of enclosed areas such as closets and the like.

Typically, in the construction of a domestic dwelling, construction panels such as sheetrock are fastened to wooden wall studs which extend vertically from the floor.

Similarly, sheetrock construction panels are fastened to the bottom edges of horizontally disposed ceiling joists.

However, the abutting edges of the wall and ceiling panels are not generally supported relative to each other.

More specifically, the top edge of the wall panel is nailed or otherwise fastened to a top plate of the wall timber. The arrangement is such that the top plate runs horizontally along the top of the vertically disposed wall studs. However, when the wall panel has been so secured, there is no provision for securing the top edge of the wall panel to the abutting edge of the ceiling panel, the ceiling panel having been previously secured to the ceiling joists. Therefore, it is often impossible to fasten the edge of the ceiling panel adjacent to the top plate and the upper edge of the wall panel.

Such fastening or anchoring of the edge of the ceiling panel is particularly difficult when such edge extends parallel to the ceiling joists because the ceiling joist nearest to the edge of the ceiling panel is often spaced therefrom. Consequently, the edge of the ceiling panel is often unsupported.

Although various adhesive tapes and the like have been proposed for joining together such abutting edges of wall and ceiling panels, these tapes often permit movement of the panels as the building dries out and settles. Such movement causes unsightly cracks between the ceiling and walls.

The present invention overcomes the aforementioned problems by the provision of a nailer device which is able to be inserted between the wall panel and the top plate in order to provide a support surface for supporting the abutting edge of the ceiling panel and which permits positive fastening of the abutting edge of the ceiling panel to the support surface of the nailer device.

Additionally, the present invention provides a nailer device which greatly simplifies the construction of walk-in closets, and the like. The arrangement is such that when one wall of the closet has been finished with a sheetrock panel, a number of nailer devices according to the present invention can be located vertically relative to each other at both sides of the wall panel. The side walls of the closet can then be readily attached to the nailer devices without the need for the insertion of relatively costly full length vertical backing timbers.

Therefore, it is a primary objective of the present invention to provide a nailer device which overcomes the aforementioned inadequacies of the prior art devices and which makes a considerable contribution to the art of joining construction panels.

Another object of the present invention is the provision of a nailer device for securing together a first and second construction panel to a top plate particularly at the seams of adjacent ceiling panels.

A further object of the present invention is the provision of a nailer device for securing abutting edges of a first and second construction panel at a seam of the wall panel to a support beam during construction of a walk-in closet or the like.

Other objects and advantages of the present invention will be readily apparent to these skilled in the art by a consideration of the detailed description contained hereinafter taken in conjunction with the annexed drawings.

SUMMARY OF THE INVENTION

The present invention relates to a nailer device for securing a first and second edge of construction panels to a top plate.

The device includes a planar member which in use of the device is disposed contiguously relative to a first panel and between the first panel and the top plate.

A further planar member is rigidly secured to the planar member and is disposed perpendicularly relative thereto such that the planar members define therebetween an elongate recess for the reception therein of the top plate. The arrangement is such that the device is supported by the top plate. The planar members also define therebetween a further elongate recess which is disposed on an opposite side of the planar member relative to the top plate such that the abutting edges of the panels are located within the further recess with the second panel disposed contiguously relative to the further member. Means are also provided for fastening the device to the top plate.

In a more specific embodiment of the present invention, the planar member is of rectangular configuration having a first and a second side. The first side is rigidly secured to the further planar member.

The second side is chamfered to an angle within the range 50 to 70 degrees relative to the top plate in order to facilitate the sliding location of the first panel within the further recess because the nailer device is secured to the top plate before fastening the wall panel to the top plate.

The planar member has a thickness within the range 0.03 to 0.1 inch so that in use of the device, the first panel is closely spaced relative to the top plate such that warping of the top of the wall panel relative to the top plate is negligible when the planar member is disposed between the first panel and the top plate.

The further planar member is rectangular and has a width which is substantially the same as the width of the planar member. The member and the further member together define a T-shaped section in which the further member is a cross member.

The further member has a thickness which is greater than the thickness of the planar member for permitting the second panel to be secured thereto.

The elongate recess is disposed such that the further planar member rests on top of the top plate.

The further recess receives the abutting edges with the top edge of the first panel being disposed towards the first side of the planar member. The second panel is disposed between the abutting edge of the first panel and the further planar member.

The means for fastening is a nail such that when the nail is driven through the planar member into the top plate, the device is fastened to the top plate.

In another embodiment of the present invention, the further planar member defines an aperture for the reception therein of a nail such that when the nail is driven into the aperture, into the top plate, the device is fastened to the top plate.

The first planar member defines a roughened surface which is disposed contiguously relative to the second panel such that when a threaded fastener is driven through the second panel into the further planar member, such threaded fastener readily penetrates into and through the further member without generating an enlarged opening the second panel.

The device also includes a reinforcing rib which is rigidly secured to the further member on an opposite side of the further member relative to the planar member. The rib extends perpendicularly relative to the planar member.

Many modifications and variations of the present invention will be readily apparent to those skilled in the art by a consideration of the detailed description contained hereinafter taken in conjunction with the annexed drawing. However, such modifications and variation fall within the spirit and scope of the present invention as defined by the appended claims.

Included in such modifications would be the elimination of any holes or apertures, the fastening nail being driven directly through the planar member and/or the further planar member.

BRIEF DESCRIPTION OF THE DRAWINGS

FIG. 1 is a perspective view of the nailer device according to the present invention and shows a top plate and the disposition of the nailer device relative to abutting edges of a first and second construction panel;

FIG. 2 is a front view partially in section of the nailer device shown in FIG. 1;

FIG. 3 is a left side view partially in section of the nailer device shown in FIG. 1; FIG. 4 is a perspective view of the nailer device shown in FIG. 1 but with the panels not yet applied thereto;

FIG. 5 is a perspective view of the nailer device as shown in FIG. 1 before being affixed to the support timber;

FIG. 6 is a top plan view of the nailer device shown in FIG. 5;

FIG. 7 is a left hand view of the nailer device shown in FIG. 5;

FIG. 8 is a rear view of the nailer device shown in FIG. 5; and

FIG. 9 is a front view showing how the nailer device according to the present invention is used in the construction of a walk-in closet or the like.

Similar reference characters refer to similar parts throughout the various embodiments of the present invention

DETAILED DESCRIPTION OF THE DRAWINGS

A nailer device generally designated 10 is shown in FIG. 1 for securing together the edges 12 and 14 of a first and second construction panel 16 and 18 to a top plate 20. As shown in FIG. 1, the first construction panel 16 is a sheetrock wall panel and the second construction panel 18 is a sheetrock ceiling panel.

The nailer device 10 includes a first planar member 22 which in use of the device 10 is disposed contiguously relative to the first panel 16 and between the first panel 16 and the top plate 20.

A second planar member 24 is rigidly secured to the first planar member 22 and is disposed perpendicularly relative thereto such that the planar members 22 and 24 define therebetween a first elongate recess 26 for the reception therein of the top plate 20. The arrangement is such that the device 10 is supported by the top plate 20.

The planar members 22 and 24 also define therebetween a second elongate recess 28 which is disposed on an opposite side of the first planar member 22 relative to the top plate 20. The arrangement is such that the abutting edges 12 and 14 of the panels 16 and 18 are located within the second recess 28 with the second panel 18 disposed contiguously relative to the second member 24.

Means such as a nail 30 are provided for fastening the device 10 to the top plate 20.

As shown in FIG. 1, the nailer device 10 includes the first planar member 22 which is of rectangular configuration and which has a first and a second side 32 and 34 respectively. The first side 32 is rigidly secured to the second planar member 24 as shown in FIG. 2.

The second side 34 is chamfered to an angle a within the range 50 to 70 degrees relative to the top plate 20 in order to facilitate the sliding location of the first panel 16 within the second recess 28 because the device 10 is fastened to the top plate 20 prior to securing the ceiling panel 18 to the second planar member 24.

The first planar member 22 has a thickness T within the range 0.03 to 0.1 inches so that in use of the device 10, the first panel 16 is closely spaced relative to the top plate 20 such that warping of the first panel 16, particularly in the vicinity of the edge 12 relative to the top plate is negligible, the first planar member 22 being disposed between the first panel 16 and the top plate 20.

The second planar member 24 is of rectangular configuration and has a width W substantially the same as the width of the first planar member 22. The planar member 22 and second planar member 24 together define a T-shaped section as shown in FIG. 3 and of which the second planar member 24 is a cross member.

The second planar member 24 has a thickness t which is greater than the thickness T of the first planar member 22 for permitting the second panel 18 to be secured thereto.

The first elongate recess 26 is disposed such that the second planar member 24 rests on the top of the top plate 20.

The second elongate recess 28 receives the abutting edges 12 and 14 of the first and second panels 16 and 18 respectively. The edges 12 and 14 are disposed adjacent to the first side 32 of the first planar member 22 and the second or ceiling panel 18 is disposed between the abutting edge 12 of the first or wall panel 16 and the second planar member 24 as shown in FIG. 3.

A shown in FIGS. 2 and 3, the means for fastening is a nail 30.

The first planar member 22 defines a hole 36 for the reception therein of the nail 30 such that when the nail 30 is driven through the hole 36 into the top plate 20, the device 10 is fastened to the top plate 20.

Alternatively, the holes can be omitted and a nail can be driven through the first planar member 22 for fastening the device to the plate 20.

Also, the second planar member 24 defines an aperture 38 for the reception therein of a further nail 40 such that when the nail 40 is driven through the aperture 38 into the top plate 20, the device 10 is fastened to the top plate 20.

The second planar member 24 defines a roughened surface 42 which is disposed contiguously relative to the second panel 18 such that when a threaded fastener 44 is driven through the second panel 18 into the second planar member 24, such threaded fastener 44 readily penetrates into and through said second member 24 without generating an enlarged opening in the second panel 18.

Additionally, the device 10 includes a reinforcing rib 46 which is rigidly secured to the second planar member 24 on an opposite side of the second planar member 24 relative to the first planar member 22. The rib 46 extends perpendicularly relative to the first planar member 22.

In operation of the present invention, the device 10 is fastened to the top plate 20 by nail 40 and/or nail 30 as shown in FIG. 3.

The ceiling panel 18 is then located with the edge 14 of the ceiling panel disposed against the first side 32 of the first planar member 22. The ceiling panel 18 is then secured to the second planar member 24 by driving the threaded fastener 44 through the ceiling panel 18 into the roughened surface 42 of the second planar member 24. Due to the roughened surface of the second planar member 24, the threaded fastener such as the screw fastener 44 will readily penetrate into the second planar member 24 without skidding on the surface thereof. Accordingly, the hole generated by the threaded fastener 44 will not become unduly enlarged during the fastening operation.

The wall panel or first panel 16 is then located with the edge 12 of the panel 16 abutting against the edge 14 of the ceiling panel 18 so that the ceiling panel 18 is disposed between the second planar member 24 and the wall panel 16.

FIGS. 4 to 8 show various views of the nailer device shown in FIGS. 1–3.

As shown in FIG. 9, the present invention is equally applicable to the construction of walk-in closets, tight corners and other enclosed areas.

Typically, a walk-in closet will be constructed by fastening a wall panel to the facing wall of the closet as shown in FIG. 9.

Thereafter, a number of nailing devices 10A according to the present invention are inserted between the wall panel 16A and the vertical support timber which in this case is a 2 by 4 inch vertical stud 20A.

The nailer devices 10A are disposed vertically relative to each other with the first planar members 22A disposed between the facing panel 16A and the backing stud 20A.

Next, a side panel 18A is secured with the corner edge thereof adjacent to the panel 16A. The panel 18A is fastened by driving threaded screws 44A through the panel 18A into each second planar member 24A of the devices 10A.

The present invention provides a simple and inexpensive means for positively securing abutting edges of panels to a support timber.

What is claimed is:

1. An improved wall panel support and securement combination, comprising:

first and second construction panels, each having a mutually abutting edge;

a support timber for stationarily supporting said first and second construction panels;

a nailer device for securing said abutting edges of said first and second construction panels to said support timber, said nailer device including:

a first planar member which in use of the device is disposed contiguously relative to the first panel and between the first panel and the support timber;

a second planar member rigidly secured to said first planar member and disposed perpendicularly relative thereto such that said first and second planar members define therebetween a first elongate recess for the reception therein of the support timber so that the nailer device is supported by the support timber;

said first and second planar members also define therebetween a second elongate recess which is disposed on an opposite side of said first planar member relative to said support timber such that abutting edges of the panels are located within said second recess with the second panel disposed contiguously relative to said second planar member; and means for fastening the nailer device to the support timber.

2. The improved wall panel support and securement combination as set forth in claim 1 wherein said first planar member is rectangular having a first and a second side, said first side being rigidly secured to said second planar member.

3. The improved wall panel support and securement combination as set forth in claim 2 wherein said second side is chamfered to an angle within the range 50 to 70 degrees relative to the support timber in order to facilitate the sliding location of the first panel within said second elongate recess.

4. The improved wall panel support and securement combination as set forth in claim 1 wherein said first planar member has a thickness within the range 0.03 to 0.1 inches so that in use of the device, the first panel is closely spaced relative to the support timber such that warping of the first panel relative to the support timber is negligible when said first planar member is disposed between the first panel and the support timber.

5. The improved wall panel support and securement combination as set forth in claim 1 wherein said second planar member is rectangular having a width substantially the same as the width of said first planar member, said first planar member and second planar member defining a T-shaped section in which said second planar member is a cross member.

6. The improved wall panel support and securement combination as set forth in claim 1 wherein said second planar member has a thickness which is greater than the thickness of said first planar member for permitting the second panel to be secured thereto.

7. The improved wall panel support and securement combination as set forth in claim 1 wherein said first elongate recess is disposed such that said second planar member rests on top of the support timber.

8. The improved wall panel support and securement combination as set forth in claim 2 wherein said second elongate recess receives the abutting edges, the edge of the first panel being disposed adjacent to said first side of said first planar member and the second panel being disposed between the abutting edge of the first panel and said first side of said first planar member.

9. The improved wall panel support and securement combination as set forth in claim 1 wherein said means for fastening is a nail.

10. The improved wall panel support and securement combination as set forth in claim 9 wherein said first planar member defines a hole for the reception therein of said nail such that when said nail is driven through said hole into the support timber, the device is fastened to the support timber.

11. The improved wall panel support and securement combination as set forth in claim 9 wherein said second planar member defines an aperture for the reception therein of said nail such that when said nail is driven through said aperture into the support timber, the device is fastened to the support timber.

12. The improved wall panel support and securement combination as set forth in claim 1 wherein said second planar member defines a roughened surface which is disposed contiguously relative to the second panel such that when a threaded fastener is driven through the second panel into said second planar member, such threaded fastener readily penetrates into and through said second planar member without generating an enlarged opening in the second panel.

13. The improved wall panel support and securement combination as set forth in claim 1 further including:

a reinforcing rib rigidly secured to said second planar member on an opposite side of said second planar member relative to said first planar member, said rib extending perpendicularly relative to said first planar member.

* * * * *